US005360200A

United States Patent [19]

Kloth et al.

[11] Patent Number: 5,360,200

[45] Date of Patent: Nov. 1, 1994

[54] LINING OF MOLTEN METAL HANDLING VESSEL

[75] Inventors: Heinz Kloth, Mettman; Klaus Friede, Voerde, both of Germany

[73] Assignee: Foesco International Limited, Birmingham, United Kingdom

[21] Appl. No.: 95,859

[22] Filed: Jul. 23, 1993

[30] Foreign Application Priority Data

Jul. 28, 1992 [GB] United Kingdom ..... 9216079.5

[51] Int. Cl.[5] ..... B22D 41/02

[52] U.S. Cl. ..... 266/44; 266/281; 264/30

[58] Field of Search ..... 266/44, 280, 281, 287; 249/157, 158, 178, 180, 161, 162; 264/30

[56] References Cited

U.S. PATENT DOCUMENTS

| | | | |
|---|---|---|---|
| 939,059 | 11/1909 | Morris | 249/157 |
| 992,652 | 5/1911 | Glavin et al. | 249/157 |
| 1,161,356 | 11/1915 | Stewart et al. | 249/180 |
| 3,944,193 | 3/1976 | Imai et al. | 266/281 |
| 3,955,721 | 5/1976 | LaBate | 266/280 |
| 4,012,029 | 3/1977 | Sequin et al. | 266/275 |
| 4,076,224 | 2/1978 | Duchateau | 266/275 |
| 4,469,309 | 9/1984 | Takashima et al. | 264/30 |
| 4,469,309 | 9/1984 | Takashima et al. | 266/44 |
| 4,589,633 | 5/1986 | Gilson et al. | 266/281 |
| 5,110,096 | 5/1992 | Zacharias | 266/227 |
| 5,139,239 | 8/1992 | Eccleston | 266/275 |
| 5,217,929 | 6/1993 | Taft | 501/84 |

FOREIGN PATENT DOCUMENTS

| | | | |
|---|---|---|---|
| 1070476 | 1/1980 | Canada . | |
| 064863 | 11/1982 | European Pat. Off. . | |
| 2657549 | 8/1991 | France . | |
| 4041610 | 12/1990 | Germany . | |
| 0221644 | 12/1983 | Japan | 266/281 |
| 2257779 | 1/1993 | United Kingdom . | |

*Primary Examiner*—Scott Kastler
*Attorney, Agent, or Firm*—Nixon & Vanderhye

[57] ABSTRACT

An expendable lining may be applied over the interior walls of a metal handling vessel for molten metal, e.g. a tundish. The expendable lining is usually applied over a relatively permanent, e.g. refractory brick, lining.

If the expendable lining is formed by placing a suitable former inside the vessel to define a space corresponding to the desired lining, filling the space with particulate refractory material and heating, it has been found difficult to provide adequately uniform heating and to avoid distortion of the former.

The invention provides a former for the in-situ manufacture of an expendable lining (22) in a molten metal handling vessel (20, 44), the former (23, 43) being a box-like construction to be inserted in the vessel (20, 44) in one-piece, in which the box-like construction (23, 43) comprises at least one central channel-shaped portion (24) and two end portions (25) each end portion (25) being constrained to be able to move in a sliding overlapping relationship with a or the central portion (24).

21 Claims, 4 Drawing Sheets

LINING OF MOLTEN METAL HANDLING VESSEL

This invention relates to the lining of molten metal handling vessels, for example a tundish or a ladle. For convenience the invention will be described with specific reference to tundishes.

In the continuous casting of metals, e.g. steel, molten metal is cast into a continuous casting mould via an intermediate vessel which acts as a constant head reservoir, this intermediate vessel being known as a tundish. The tundish has a metal floor and walls and one or more outlet nozzles set in the floor. To protect the metal floor and walls of the tundish from the effects of the molten metal it is usual to line the interior of the tundish with a relatively permanent lining, sometimes referred to as a semi-permanent lining; often made of bricks or in the form of a cast monolithic lining. The tundish may additionally be provided with an inner expendable lining of refractory, heat-insulating material. The expendable lining has to be renewed for each casting sequence.

Expendable inner linings have to meet various distinct requirements and certain of these conflict to a greater or lesser extent. In particular, while it is desirable for the expendable lining to be highly heat-insulating, it is also desirable for it to have substantial resistance to erosion by molten metal and slag. However, any change in the nature of the lining that improves its heat-insulating properties is usually associated with a reduction in its density, which tends also to result in reduced erosion-resistance.

Not only must the expendable lining meet the physical property requirements outlined above, it must be of a composition or physical nature that enables its application as an effective lining to be carried out efficiently, economically and in a consistently reliable manner. Thus a number of different basic methods of applying the expendable lining have been proposed. These include:

i) the pre-forming of refractory, heat-insulating slabs or boards, which are then fitted over the relatively permanent lining ii) spraying, trowelling or gunning a suitable aqueous refractory composition over the relatively permanent lining and drying the so-applied composition to form a unitary expendable lining iii) placing a suitable former inside the tundish to define a space between the relatively permanent lining and the former, the space corresponding to the desired expendable lining, filling the space with a particulate refractory composition, heating to form the expendable lining from the particulate composition and then removing the former.

The present invention is concerned to provide an improved means of carrying out method iii) above, i.e. using a former which is usually of metal.

The heating stage by which the particulate composition is converted into the desired expendable lining is conventionally achieved by heating the former by gas, the gas being supplied through a heating tube installed along the inner wall of the former. The conventional arrangement has certain disadvantages:

In particular, it is difficult to produce uniform and controlled flames and hence uniform heating around the entire former. Thus local overheating can take place and this can result in distortion of the former. Moreover, a consistently uniform expendable layer may not result in view of the non-uniform heating.

Moreover, in order to compensate for the thermal expansion of the former in the heating step, it has been found necessary to make the former in at least two sections to prevent distortion. This necessitates increased staff and double crane-handling operations to enable the former to be assembled in-situ inside the tundish.

The present invention aims to provide an improved means of lining a tundish using a unitary former to prevent former distortion and to improve uniformity of heating.

Accordingly in one aspect, the invention provides a former for the in-situ manufacture of an expendable lining in a molten metal handling vessel, the former being a unitary box-like construction to be inserted in the vessel in one piece, the box-like construction comprising at least one central channel-shaped portion and two end portions each end portion being constrained to be able to move in a sliding overlapping relationship with a/or the central portion.

In another aspect the invention provides a method of forming an expendable lining on the inner walls of a molten metal handling vessel, in which a former is made as a unitary box-like construction having at least one central channel-shaped portion and two end portions, each end portion being constrained to be able to move in a sliding overlapping relationship with a or the central portion, the unitary former is placed inside the vessel to define a gap between its exterior walls and the interior walls of the vessel, the gap corresponding to the thickness or the desired expendable lining, the gap is filled with a refractory composition, the former is heated to set the refractory composition into a coherent lining and the former is then removed.

Normally a single central portion is all that is required, i.e. to provide a unitary construction former from three portions, but additional central portions may be used if desired.

The invention enables the expansion of the former during the heating step and the later contraction on cooling to be accommodated by relative movement between the end portions and central portion, thereby avoiding any risk of deformation, while at the same time its unitary construction reduces manpower requirements and crane-handling movements in the installation and removal stages.

Furthermore, the construction of former of the invention readily lends itself to improvements in the application of heat whereby more uniform heating can be achieved.

Thus, the former being of unitary box-like construction can be provided with a close-fitting insulated lid, preferably as a one-piece cover. This enables the cover to be provided with a hot-air inlet and exhaust air outlet so that, for example, a swivelling hot-air duct can be mechanically coupled to the former. A series of adjustable outlet ports for the hot air can be provided in the cover so that the former is heated carefully and uniformly to give not only an improved lining each time but a higher service life for the former.

The central and end portions of the former may be connected into the desired unitary construction by, for example, a series of guide shafts to which are attached longitudinally-extending steel springs. The springs can be extended and contracted by the expansion and contraction of the former on heating and cooling when the end portions and central portion are enabled to move in slidable relationship to each other.

The lid of the former may be of the same or different material to that of the former itself and so may have the same or different thermal expansion characteristics. The attachment means between lid and former can be designed to cater for such differential thermal characteristics. For example, the lid may be attached by one or more lug and slot arrangements. Thus a lug fixed to the wall of the former engages a slot in the lid and may be locked in position, e.g. by a wedge-shaped pin. The dimensions of the slot and lug then prevent excessive relative movement between lid and former in an "up and down" direction but allow relative movement in the longitudinal direction of the former.

As an example of the effectiveness of the present invention, a former suitable for a 50 ton steel capacity tundish may have an overall length about 7 meters. Such a steel former will expand in length by about 24 mm during the heating stage to consolidate the expendable lining. Relative movement of 12 mm between the central portion and each end portion of a former of the invention can readily be accommodated so that neither distortion of the former nor movement of the former to reduce undesirably the gap between it and the tundish walls takes place.

BRIEF DESCRIPTION OF THE DRAWINGS

The invention is further illustrated by way of example only with reference to the accompanying drawings in which:

In FIGS. 1 and 2 is shown a prior art arrangement in which a tundish 10 has a permanent lining 11, an expendable lining 12 and a suitably box-shaped former 13. A gas heating tube 14 is positioned to enter the tundish and run down the inside of a wall of the former and then around inside the four walls of the former as indicated.

It will be appreciated that uniform heating of the expendable lining precursor to form expendable lining 12 is difficult, if not impossible, to achieve from such an arrangement. The former may be one-piece or multi-piece, in the latter case having to be installed and assembled in-situ.

Figure 1:
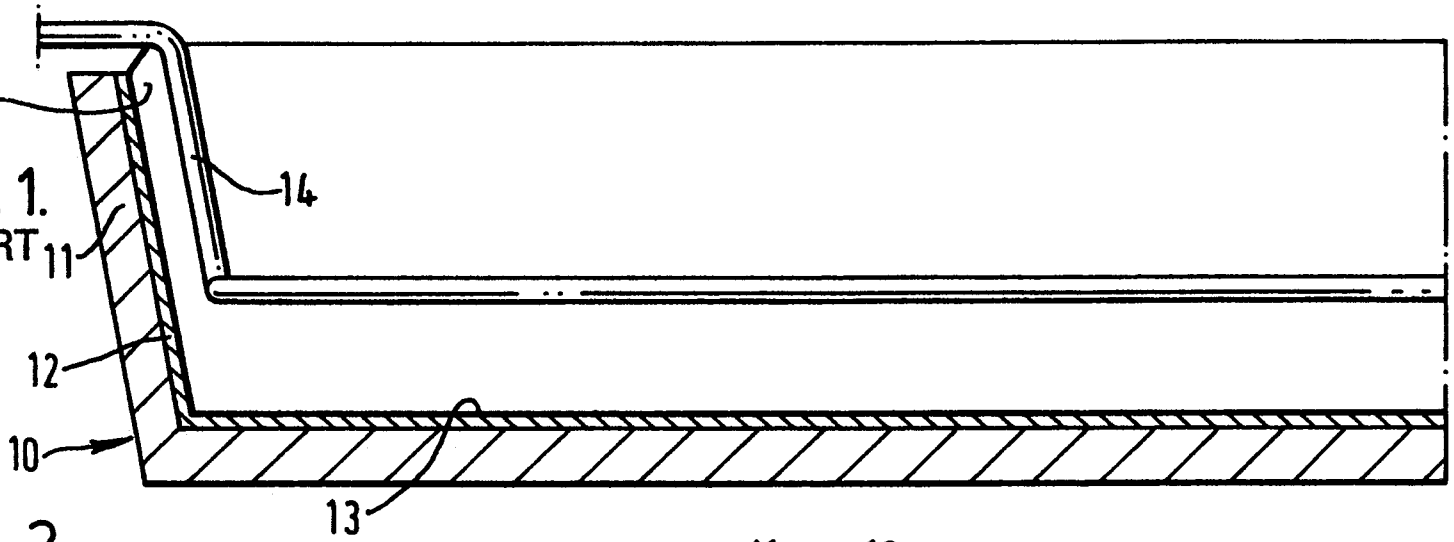
FIG. 1. PRIOR ART
FIG. 1 is a diagrammatic representation, part-sectioned, of a tundish containing a prior art former.
Figure 2:
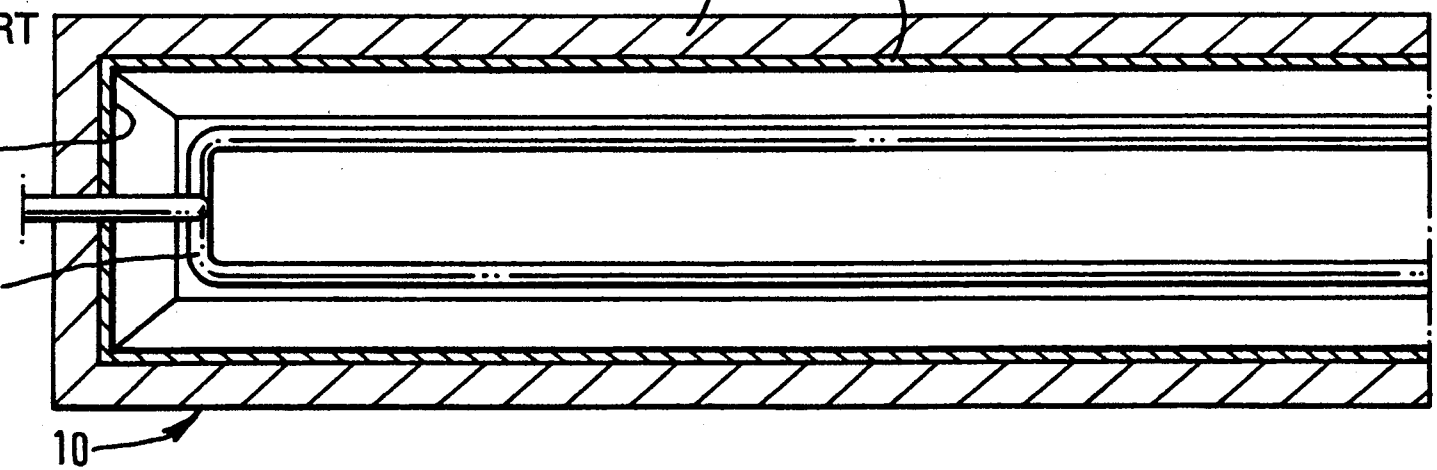
FIG. 2. PRIOR ART
FIG. 2 is a plan view corresponding to FIG. 1.
Figure 3:
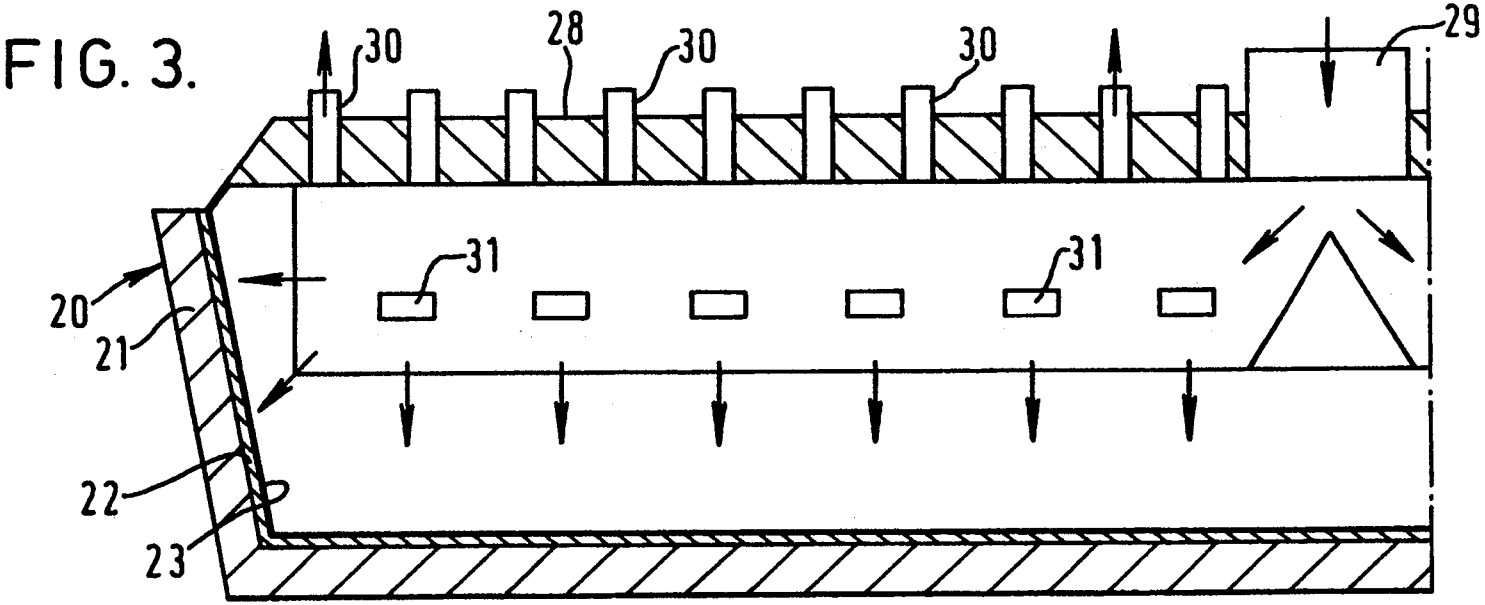
FIG. 3 is a representation similar to FIG. 1 but showing a tundish containing a former of the present invention.
Figure 4:
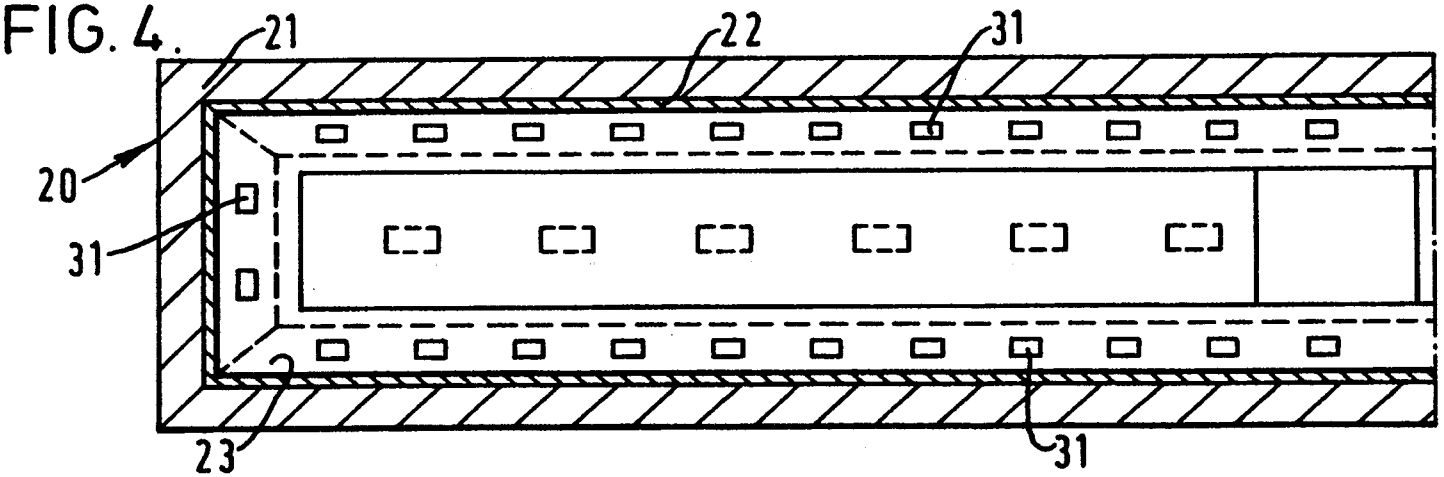
FIG. 4 is a plan view corresponding to FIG. 3.
Figure 5:
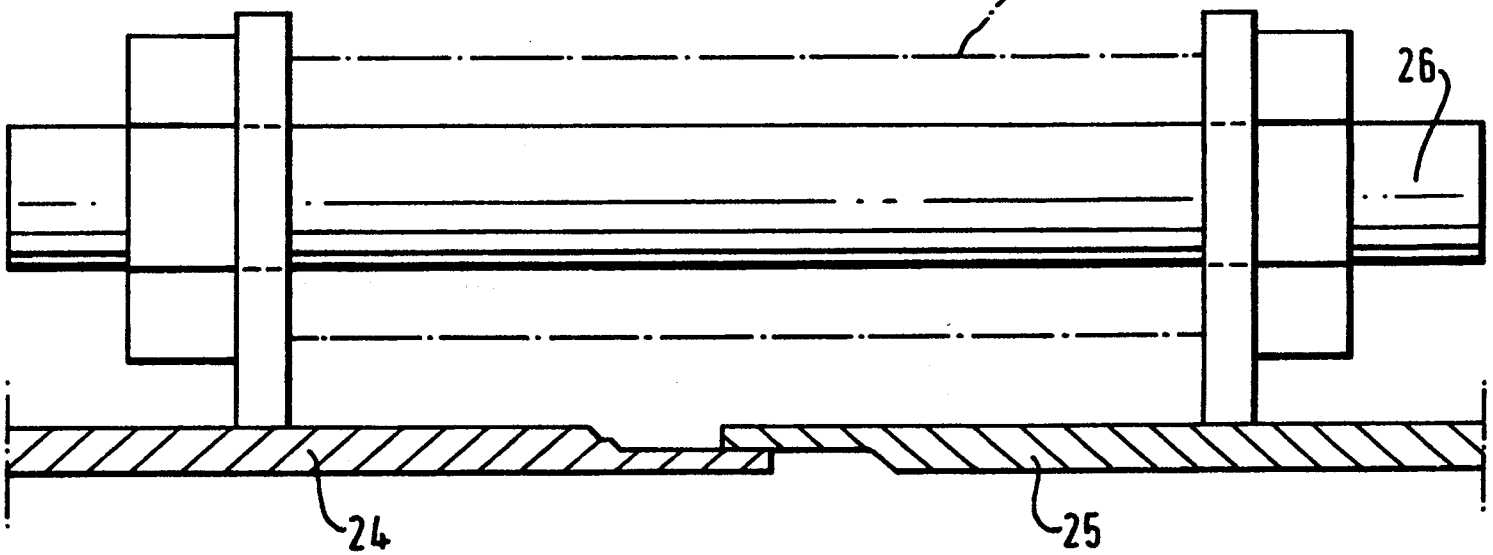
FIG. 5 is an elevation, part-sectioned, showing the region of a former of the invention where an end portion and the central portion overlap.

In FIGS. 3, 4 and 5, an improved arrangement of the invention is shown. Tundish 20 has a permanent lining 21 over which an expendable lining 22 has been formed between lining 21 and a suitably box-shaped former 23. Referring to FIG. 5, it can be seen that former 23 has a central section 24 which is in slideable engagement with one end section 25. Another end section (not shown) will be similarly slidably engaged with the other end of central section 24.

The sections of the former 23 are held together by an arrangement of guide shafts 26 and springs 27 and the former is positioned in the tundish as a unitary construction including its lid.

Referring again to FIGS. 3 and 4, the former 23 is provided with a close-fitting insulating lid 28. The lid has an inlet port 29 through which hot air or other gas can be admitted to the interior of the former 23 and a series of exhaust outlets 30. A series of outlets 31 is also provided around the walls of former 23. By this means the former enables the expendable lining precursor to be heated uniformly and efficiently to form expendable lining 22.

Figure 6:
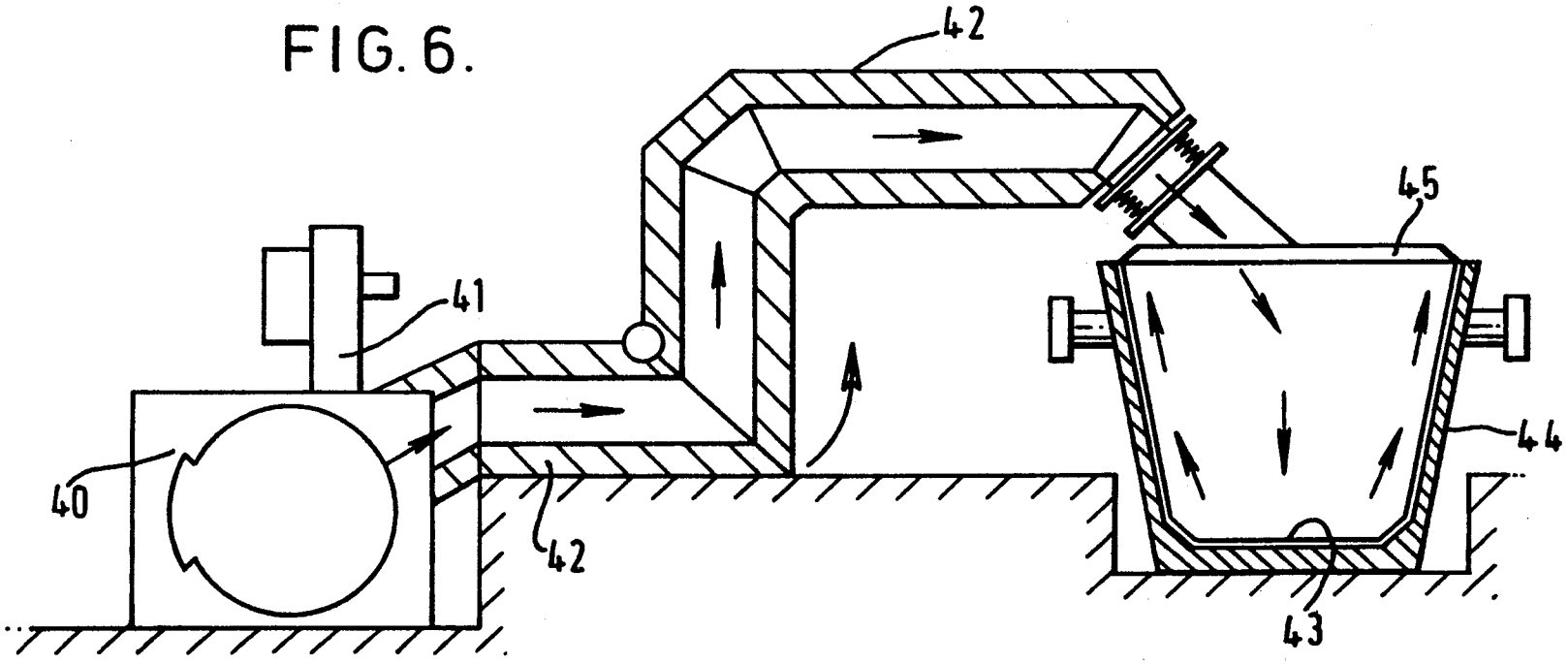
FIG. 6 is a diagrammatic representation in part section showing the coupling of a hot air duct to the lid of a former in position in a tundish.

FIG. 6 illustrates a system for applying hot air or other hot gas to the interior of a former in a tundish. A hot air generator 40 with a ventilator 41 provides a stream of hot air via ducting 42 to the inside of former 43 in tundish 44 through the lid 45 of the former.

We claim:

1. A former for in-situ manufacture of an expendable lining in a molten metal handling vessel, comprising:

a three dimensional unitary structure comprising at least one channel shaped central section and two end sections, the sections dimensioned to fit within a molten metal handling vessel; and said end sections disposed in sliding overlapping relationship with said at least one central section so as to slidably move with respect to said at least one central section in response to thermal expansion as the former is heated in the molten metal handling vessel during use of the former.

2. A former according to claim 1, in which said sections of the former are held together by an arrangement of guide shafts and springs which accommodate the sliding movement of said sections.

3. A former according to claim 1, which has a single central portion.

4. A former according to claim 1, which has a close-fitting, one-piece lid.

5. A former according to claim 4, in which the lid and former have different thermal characteristics and attachment means are provided between said lid and said former for accommodating differential thermal expansion between said lid and said former.

6. A former according to claim 4, in which the lid has an inlet port for hot gas and a series of adjustable outlet ports.

7. A former according to claim 6, in which the inlet port is connectable to a swivelling hot-air duct.

8. A former according to claim 1, in which the former has a series of outlets in its walls.

9. In combination a molten metal handling vessel having an interior lining and a former for in-situ manufacture of the interior lining, said former removably disposed witch said vessel and comprising:

a three dimensional unitary structure including at least one channel shaped central section and two end sections;

means for supplying heating fluid to said former for heating said former when it is within said vessel; and said sections mounted for relative movement with respect to each other in response to thermal expansion as said former is heated by said heating means in said molten metal handling vessel during use of the former.

10. A combination as recited in claim 9 wherein said end sections are slidable relative to said central section said that said end sections slidably move with respect to said central section as said former is heated by said heating means.

11. A combination as recited in claim 10 wherein said at least one central section consists of a single central section.

12. A combination as recited in claim 9 further comprises a lid covering at least said central section.

13. A combination as recite in claim 12 wherein said heating means comprises: a source of hot gas remote from said vessel; a conduit for conducting hot gas to said lid frown said source; an inlet port in said lid for receipt of hot gas from said conduit; and a series of outlet ports in said lid; and wherein said former sections also have a series of outlet ports therein through which hot gas flows from said lid outlets into contact with said in,riot lining of said vessel.

14. A combination as recited in claim 13 wherein said vessel comprises a tundish.

15. A former for in-situ manufacture of an expendable lining in a molten metal handling vessel, comprising:

a three dimensional unitary structure comprising at least one channel shaped central section and two end sections, the sections dimensioned to fit within a molten metal handling vessel; and a close-fitting one-piece lid covering said three-dimensional structure, said lid having an inlet port for hot gas, and a series of adjustable outlet ports.

16. A former as recited in claim 15 further comprising a series of outlet ports in said former through which hot gas flows from said lid outlets into contact with the molten metal handling vessel.

17. A method of forming an expendable lining on the interior walls of a molten metal handling vessel using a former having a unitary construction with at least one central channel-shaped section and two end sections slidable in overlapping relationship with the central section, comprising the steps of:

(a) placing the former into the vessel to define a gap between the former and the interior walls of the vessel;

(b) filling the gap with a refractory composition; and (c) heating the fondler to cause the refractory composition to form a coherent lining on the interior walls of the vessel, thermal expansion of the former being accommodated by the end sections of the fondler sliding with respect to the central section.

18. A method as recited in claim 17 wherein the former includes a close-fitting lid having a gas inlet, port, and wherein step (c) is practiced by passing hot gas into the inlet port of the lid.

19. A method as recited in claim 18 wherein the lid includes outlet ports and the sections of the former have outlets, and wherein step (c) is further practiced by passing the hot gas through the outlet ports in the lid into the former sections, and then through the former section outlets into contact with the refractory composition.

20. A method as recited in claim 18 wherein step (c) is further practiced by conveying hot gas into the inlet port from a hot gas generator via a ventilator and adjustable ducting.

21. A method of forming an expendable lining on the interior walls of a molten metal handling vessel using a former having a unitary construction and a close-fitting one-piece lid having a gas inlet port, comprising the steps of:

(a) placing the former into the vessel to define a gap between the former and the interior walls of the vessel;

(b) filling the gap with a refractory con, position; and (c) heating the former to cause the refractory con, position to former a coherent lining on the interior walls of the vessel by passing hot gas into the inlet port of the lid, to circulate into the former.

* * * * *

UNITED STATES PATENT AND TRADEMARK OFFICE

CERTIFICATE OF CORRECTION

PATENT NO. : 5,360,200
DATED : November 1, 1994
INVENTOR(S) : KLOTH et al

It is certified that error appears in the above-identified patent and that said letters patent is hereby corrected as shown below:

Column 4, line 54, change "witch" to -- within --;

Column 5, line 11, change "froun" to -- from --;
line 16, change "in,riot" to -- interior --;

Column 6, line 5, change "fondler" to -- former --;
line 8, change "fondler" to -- former --;
line 33, change "con, position" to -- compositon --;
lines 34 and 35, change "con, position" to -- compositon --.
line 35, "Former" should read --Form --.

Signed and Sealed this

Tenth Day of January, 1995

*Attest:*

*Attesting Officer*

BRUCE LEHMAN

*Commissioner of Patents and Trademarks*